US009782992B2

(12) United States Patent
Ishikawa

(10) Patent No.: US 9,782,992 B2
(45) Date of Patent: Oct. 10, 2017

(54) EJECTION APPARATUS AND HUMIDIFICATION APPARATUS

(71) Applicant: FUJI XEROX CO., LTD., Tokyo (JP)

(72) Inventor: Kazuki Ishikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/194,669

(22) Filed: Jun. 28, 2016

(65) Prior Publication Data

US 2017/0036470 A1 Feb. 9, 2017

(30) Foreign Application Priority Data

Aug. 7, 2015 (JP) ..... 2015-157460
Jan. 18, 2016 (JP) ..... 2016-007047

(51) Int. Cl.
*B41J 29/377* (2006.01)
*B41J 2/14* (2006.01)

(52) U.S. Cl.
CPC ..... *B41J 29/377* (2013.01); *B41J 2/1408* (2013.01)

(58) Field of Classification Search
CPC ..... B41J 2/1408; B41J 2/2114; B41J 11/002; B41J 11/0015; B41J 29/377
See application file for complete search history.

(56) References Cited

U.S. PATENT DOCUMENTS 8,827,412 B2 * 9/2014 Kanome ..... B41J 29/377 347/104
2011/0109710 A1 5/2011 Miyakoshi et al.

FOREIGN PATENT DOCUMENTS

| | | |
|---|---|---|
| JP | 2005-178252 | 7/2005 |
| JP | 2007-101584 | 4/2007 |
| JP | 2008-056452 | 3/2008 |
| JP | 2011-121354 | 6/2011 |

OTHER PUBLICATIONS

Abstract and machine translation of JP 2008-056452.
Abstract and machine translation of JP 2007-101584.
Abstract and machine translation of JP 2005-178252.

* cited by examiner

*Primary Examiner* — Juanita D Jackson
(74) *Attorney, Agent, or Firm* — Fildes & Outland, P.C.

(57) ABSTRACT

An ejection apparatus is provided and includes: a cooling unit that cools a recording medium; a humidification unit that humidifies the recording medium in a state of the recording medium having a temperature lowered by the cooling unit; and an ejection unit that ejects droplets on the recording medium that is humidified by the humidification unit.

11 Claims, 6 Drawing Sheets

200
230
233
90
99
95
93
66
91
34
32
30
22
21
20
P
66
66
66
62
16
13
40
42K
42Y
42M
42C
66
66
66

EJECTION APPARATUS AND HUMIDIFICATION APPARATUS

CROSS-REFERENCE TO RELATED APPLICATIONS

This application is based on and claims priority under 35 USC 119 from Japanese Patent Application Nos. 2015-157460 and 2016-007047, filed on Aug. 7, 2015 and Jan. 18, 2016, respectively.

TECHNICAL FIELD

The present invention relates to an ejection apparatus and a humidification apparatus.

SUMMARY

An aspect of the invention provides an ejection apparatus including:

a cooling unit that cools a recording medium;

a humidification unit that humidifies the recording medium in a state of the recording medium having a temperature lowered by the cooling unit; and an ejection unit that ejects droplets on the recording medium that is humidified by the humidification unit.

BRIEF DESCRIPTION OF THE DRAWINGS

Exemplary embodiment(s) of the present invention will be described in detail based on the following figures, wherein.

DETAILED DESCRIPTION

Hereinafter, examples of exemplary embodiments of the invention will be described based on the drawings.

First Embodiment

Image Forming Apparatus 10

Figure 1:
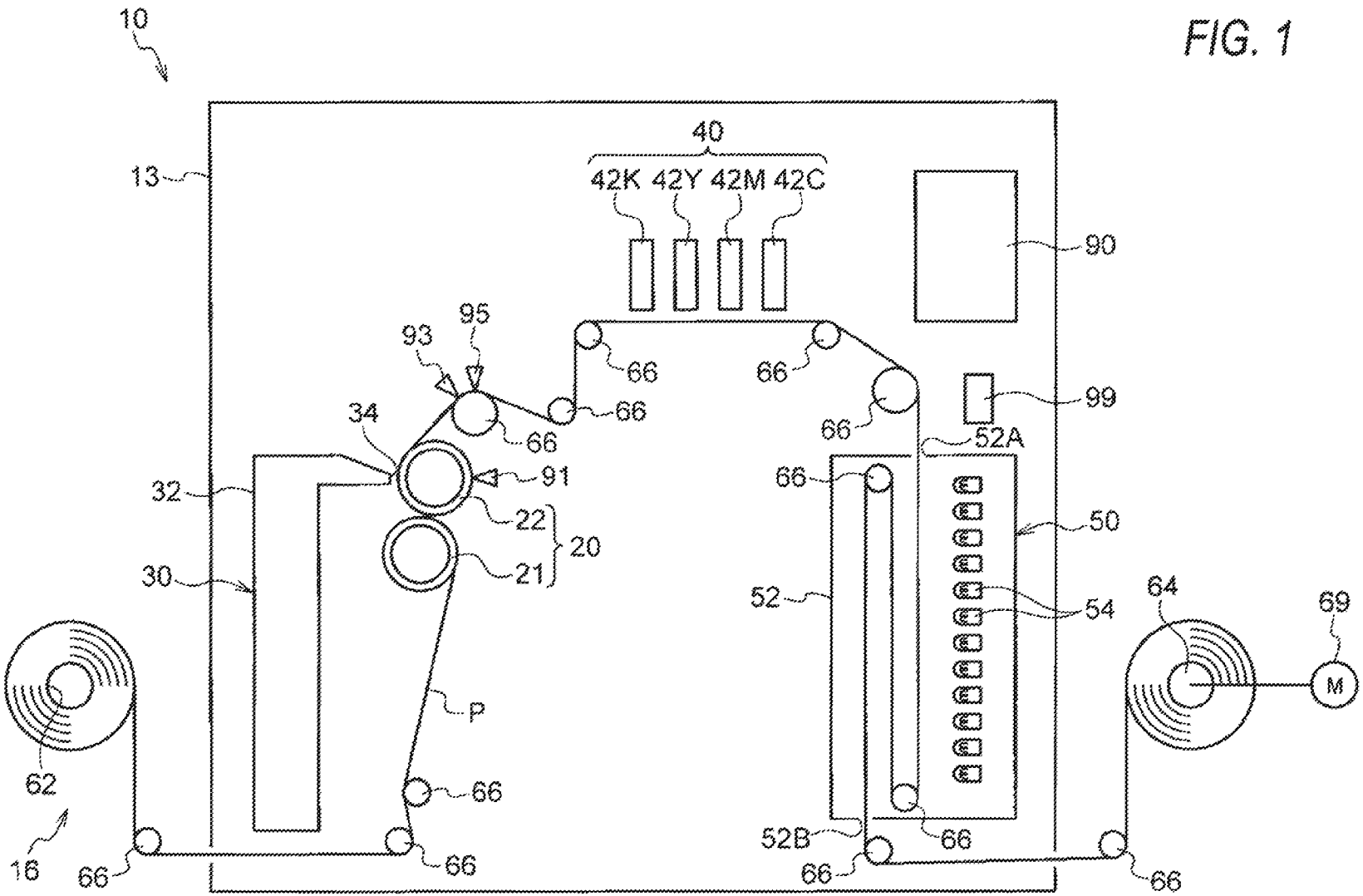
FIG. 1 is a schematic diagram illustrating a configuration of an image forming apparatus according to a first embodiment.

First an image forming apparatus 10 (an example of an ejection apparatus) will be described. FIG. 1 is a schematic diagram illustrating the configuration of the image forming apparatus 10.

As illustrated in FIG. 1, the image forming apparatus 10 includes an image forming apparatus main body 13 (housing), a cooling unit 20 cooling a continuous form paper P (an example of a recording medium), a humidifier 30 (art example of the humidification unit) humidifying the continuous form paper P, and an ejection unit 40 (an example of an ejection portion) ejecting ink droplets (an example of droplets) on the continuous form paper P.

The image forming apparatus 10 includes a transport unit 16 transporting the continuous form paper P (an example of a recording medium), a drying unit 50 drying the ink on the continuous form paper P, a control unit 90 controlling each unit of the image forming apparatus 10, and a temperature sensor 99 measuring the temperature of the inside of the image forming apparatus main body 13.

Further, the image forming apparatus 10 includes a temperature sensor 91 measuring the temperature of the cooling unit 20, a temperature sensor 93 measuring the temperature of the continuous form paper P, and a water content sensor 95 measuring the water content of the continuous form paper P.

The cooling unit 20, the humidifier 30, the ejection unit 40, and the drying unit 50 are disposed in this order from the upstream side toward the downstream side in the transport direction of the continuous form paper P. Accordingly, a cooling operation, a humidifying operation, an ejection operation and a drying operation are performed in this order, on each portion of the continuous form paper P that is transported by the transport unit 16.

Transport Unit 16

The transport unit 16 includes an unwinding roll 62 unwinding the continuous form paper P, a winding roll 64 winding the continuous form paper P, and plural transport rolls 66 transporting the continuous form paper P. The winding roll 64 is rotatably driven by a drive unit 69. Accordingly, the winding roll 64 winds the continuous form paper P, and the unwinding roll 62 unwinds the continuous form paper P.

The plural transport rolls 66 are wound with the continuous form paper P between the unwinding roll 62 and the winding roll 64. Accordingly, the transporting path of the continuous form paper P from the unwinding roll 62 to the winding roll 64 is determined. The winding roll 64 winds the continuous form paper P, and thus the plural transport rolls 66 are driven to rotate by the continuous form paper P which progresses to the winding roll 64 side.

Ejection Unit 40

The ejection unit 40 includes ejection heads 42K, 42Y, 42M, 42C (hereinafter, referred to as 42K to 42C) that eject ink droplets (an example of droplets) of respective colors of black (K), yellow (Y), magenta (M), and cyan (C) on the continuous form paper P. The ejection heads 42K to 42C eject the ink droplets of the respective colors on the continuous form paper P, and thus an image is formed on the continuous form paper P.

Drying Unit 50

As illustrated in FIG. 1, the drying unit 50 includes a housing 52, and plural infrared heaters 54 disposed at the inside of the housing 52. An inlet 52A into which the continuous form paper P enters is formed at the top of the housing 52. An outlet 52B from which the continuous form paper P comes out is formed at the bottom of the housing 52.

The plural infrared heaters 54 are disposed along the vertical direction, facing the image forming surface of the continuous form paper P which is transported in the inside of the housing 52. The infrared heater 54 heats the image forming surface of the continuous form paper P, and thus the drying unit 50 dries the ink on the image forming surface.

Cooling Unit 20

As illustrated in FIG. 1, the cooling unit 20 includes a first cooling roll 21 and a second cooling roll 22 that cool the continuous form paper P. The continuous form paper P is wound around the first cooling roll 21 and the second cooling roll 22 in an S-shape. Accordingly, the outer peripheral surface of the first cooling roll 21 is in contact with the image forming surface of the continuous form paper P, and the outer peripheral surface of the second cooling roll 22 is in contact with the non-image forming surface of the continuous form paper P (the surface opposite to the image forming surface). The first cooling roll 21 and the second cooling roll 22 are configured to be driven to rotate by the continuous form paper P which progresses to the winding roll 64 side.

The first cooling roll 21 and the second cooling roll 22 are respectively configured as a cylindrical-shaped roll. The first cooling roll 21 and the second cooling roll 22 are made of a material having excellent thermal conductivity, for example, a metal material such as aluminum.

Both end portions of the first cooling, roll 21 and both end portions of the second cooling roll 22 are respectively connected to a single heat exchanger (not illustrated) in parallel, via, for example, a flow pipe in which refrigerant flows (not illustrated). The refrigerant cooled by the heat exchanger flows through the inside of the first cooling roll 21 and the second cooling roll 22 via the flow pipe, and thus the temperatures of the first cooling roll 21 and the second cooling roll 22 decrease. The first cooling roll 21 has approximately the same temperature as that of the second cooling roll 22.

The outer peripheral surfaces of the first cooling roll 21 and the second cooling roll 22 are in contact with the continuous form paper P, and thus the cooling unit 20 cools the continuous form paper P. The temperatures of the outer peripheral surfaces of the first cooling roll 21 and the second cooling roll 22 (cooling temperature) can be set, for example, within a range from 3° C. to 20° C.

Humidifier 30

The humidifier 30 includes a humidifier main body 32, and an air outlet 34 that is formed in the humidifier main body 32 and blows out humidified air (an example of gas). The air outlet 34 is open at the position facing the continuous form paper P which is wound around the second cooling roll 22.

For example, in the humidifier main body 32, water is evaporated to generate water vapor by heating, and the water vapor is blown from the air outlet 34 together with air by a blower (not illustrated) included in the humidifier main body 32. Thus, the humidifier 30 generates the humidified air. The humidification amount of the humidifier 30 (emission amount of water vapor per hour) can be set, for example, within a range from 50 ml/h to 500 ml/h. By humidifying with this humidification amount, the humidifier 30 can set the humidity in the vicinity of the portion of the continuous form paper P facing the air outlet 34, for example, within a humidity range from 50% to 90%.

Figure 2:
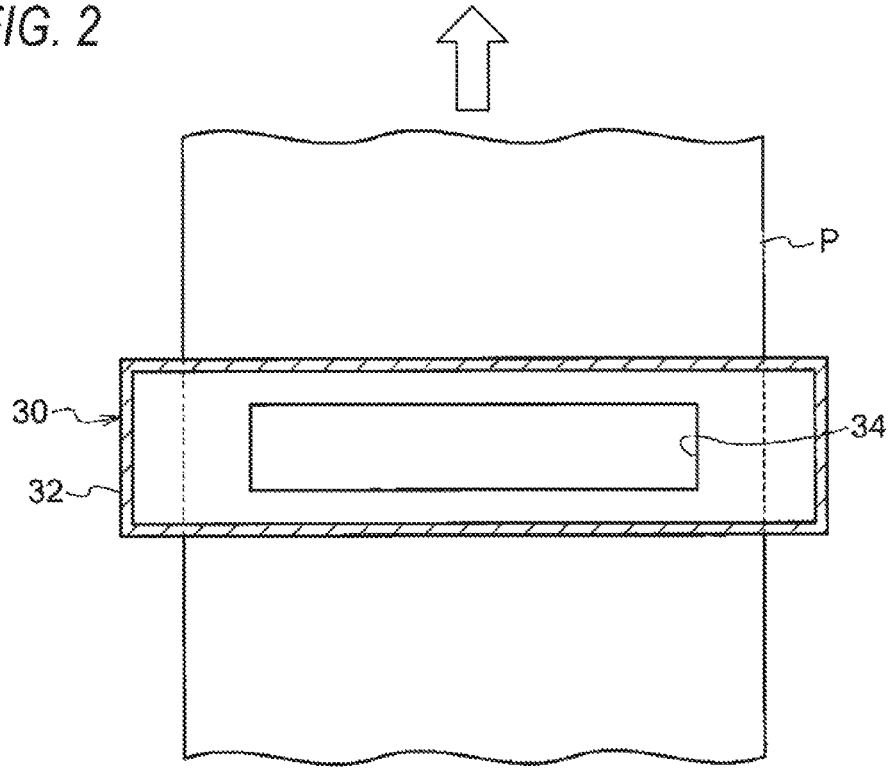
FIG. 2 is a diagram illustrating the relationship between the width of a continuous form paper and the width of an air outlet of a humidification apparatus according to the first embodiment.

As illustrated in FIG. 2, the width of the air outlet 34 (the length of the second cooling roll 22 along the axial direction) is set to be equal to or narrower than the width of the continuous form paper P. The air outlet 34 supplies the humidified air to the continuous form paper P by blowing the humidified air into the continuous form paper P in the range from the one side end to the other side end of the continuous form paper P. In other words, in the humidifier 30, the supply width for supplying the humidified air to the continuous form paper P is set to be equal to or narrower than the width of the continuous form paper P.

Figure 3:
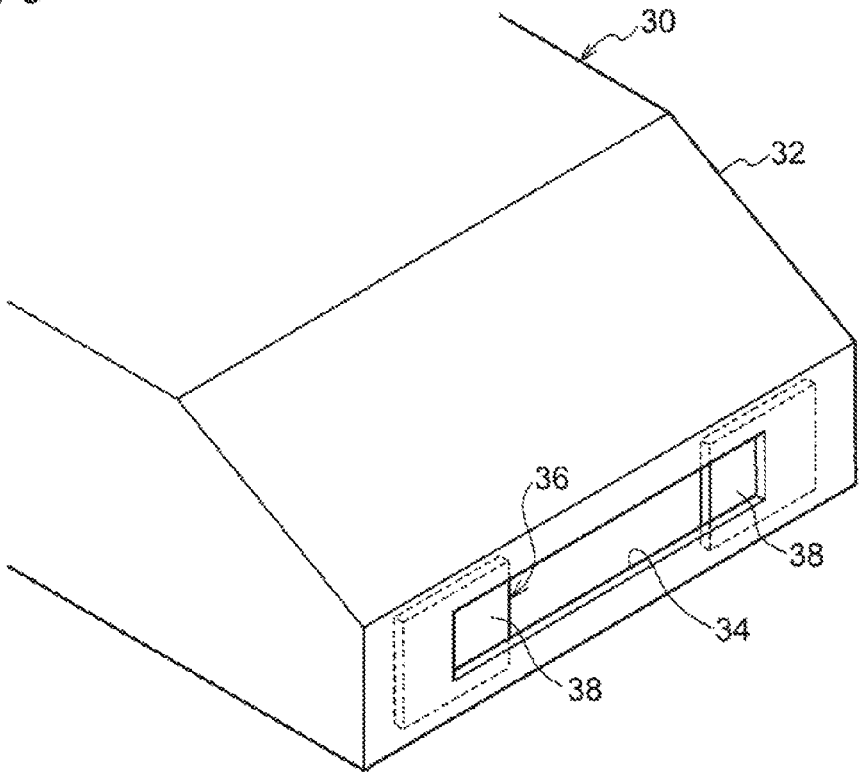
FIG. 3 is a perspective view illustrating an adjusting mechanism of the humidification apparatus according to the first embodiment.

As illustrated in FIG. 3, the humidifier 30 includes an adjusting, mechanism 36 that can adjust the supply width for supplying the humidified air to the continuous form paper P based on the width of the continuous form paper P. Specifically, for example, the adjusting mechanism 36 is configured by a shutter 38 (opening and closing portion) that opens and closes a portion of the air outlet 34. The shutter 38 is respectively disposed at each of one end portion and the other end portion of the air outlet 34 in width direction. The shutter 38 closes one end portion and the other end portion of the air outlet 34 in width direction by a manual operation or driving, and thus the width of the air outlet 34, that is, the supply width is narrowed. The adjusting mechanism 36 is not illustrated in FIG. 2. The adjusting mechanism 36 is not limited to the configuration described above, and may be configured to, for example, open and close the air outlet 34 from above or below in a step manner.

In this way, the humidifier 30 humidifies the continuous form paper P by supplying the water vapor to the continuous form paper P. The humidifier 30 preferably humidifies the continuous form paper P in a state where the temperature of the continuous form paper P is lowered, and the start timing of the execution of the cooling operation and the humidifying operation for each portion of the continuous form paper P may be changed.

Control Unit 90

Figure 4:
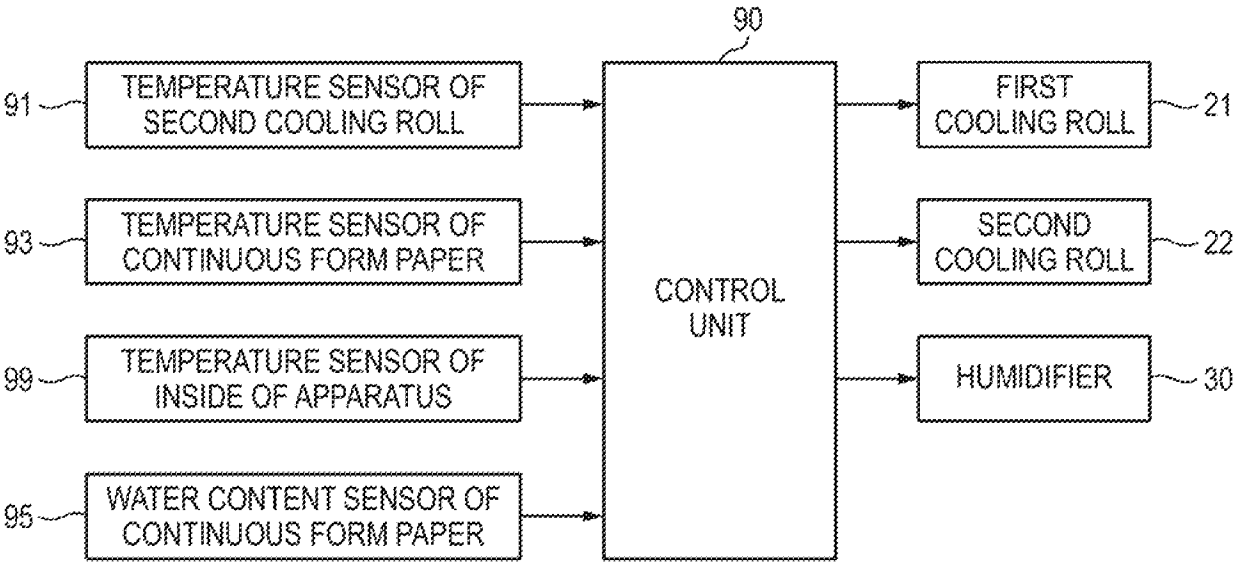
FIG. 4 is a block diagram illustrating a control system according to the first embodiment.

As illustrated in FIG. 4, a temperature sensor 91 that measures the temperature of the cooling unit 20 (hereinafter, referred to as cooling temperature) and a temperature sensor 93 that measures the temperature of the continuous form paper P (hereinafter, referred to as medium temperature) are connected to the control unit 90. In addition, a temperature sensor 99 that measures the temperature of the inside of the image forming apparatus main body 13 (hereinafter, referred to as in-apparatus temperature) and a water content sensor 95 that measures the water content of the continuous form paper P (hereinafter, referred to as paper water content) are connected to the control unit 90.

As an example, the temperature sensor 91 measures the temperature of the outer peripheral surface of the second cooling roll 22. In other words, in the present embodiment, as the cooling temperature, the temperature of the cooling unit 20 itself is measured. In the present embodiment, the temperature of the first cooling roll 21 is substantially the same as that of the second cooling roll 22 and thus the temperature of only the second cooling roll 22 is measured. However, for example, the temperature of the first cooling roll 21 and the temperature of the second cooling roll 22 may be measured, and the temperature obtained by averaging the two temperatures may be used as the cooling temperature. That is, in a case where the cooling unit includes plural cooling members, the cooling temperature may be calculated with reference to each temperature of the cooling members. Further, the temperature obtained by measuring the temperature of the refrigerant that flows through the first cooling roll 21 and the second cooling roll 22 may be used as the cooling temperature. In this case, the temperature of the refrigerant before the refrigerant is supplied to the first cooling roll 21 and the second cooling roll 22, that is, the temperature of the refrigerant before heat exchange is performed between the refrigerant and the continuous form paper P, may be used as the cooling temperature.

The temperature sensor 93 is disposed between the second cooling roll 22 and the ejection unit 40. In other words, the temperature sensor 93 measures the temperature of the continuous form paper P that is cooled by the first cooling roll 21 and the second cooling roll 22 and humidified by the humidifier 30, before the continuous form paper P is transported to the ejection unit 40. In the present embodiment, the temperature of the continuous form paper P after being humidified by the humidifier 30 is measured. However, the temperature of the continuous form paper P before being humidified may be measured in other words, it is preferable that the temperature of the continuous form paper P after being cooled by the cooling unit 20 is measured, and whether or not the continuous form paper P is humidified does not matter.

The water content sensor 95 obtains the water content of the continuous form paper P by, for example, measuring the electrical resistance of the continuous form paper P and converting the electric resistance value into the water content. As illustrated in FIG. 1, the water content sensor 95 is disposed between the humidifier 30 and the ejection unit 40. In other words, the water content sensor 95 measures the water content of the continuous form paper P that is humidified by the humidifier 30 before the continuous form paper P is transported to the ejection unit 40. The water content of the continuous form paper P is the weight of water included in the continuous form paper P when it is assumed that the weight of the continuous form paper P is 100. It is preferable that the water content of the continuous form paper P is adjusted within a range from 4% to 7%. When the water content of the continuous form paper P is less than 4%, the continuous form paper P absorbs moisture from the nozzles of the ejection unit 40, and thus this may cause an ejection failure of the ink. When the water content of the continuous form paper P is greater than 7%, the elasticity of the continuous form paper P decreases, and thus crinkles are likely to occur in the continuous form paper P.

The measurement results that are measured by each of the temperature sensors 91, 93, and 99 and the water content sensor 95 are transmitted to the control unit 90 from each of the temperature sensors 91, 93, and 99 and the water content sensor 95. Accordingly, the control unit 90 obtains the measurement results of the cooling temperature, the medium temperature, the in-apparatus temperature, and the paper water content.

The control unit 90 controls the cooling temperatures of the first cooling roll 21 and the cooling roll 22 based on the obtained measurement results of the medium temperature, the in-apparatus temperature, and the paper water content.

Specifically, for example, in a case where the medium temperature is a given reference medium temperature or lower and the in-apparatus temperature is a given reference in-apparatus temperature or lower, and in a case where the paper water content is equal to or greater than a given reference water content, the control unit 90 sets the cooling temperature to a given set cooling temperature an example of a setting value). In a case where at least one of the following conditions is satisfied, the conditions including a condition in which the medium temperature is higher than the given reference medium temperature, a condition in which the in-apparatus temperature is higher than the given reference in-apparatus temperature, and a condition in which the paper water content is lower than the given reference water content, the control unit 90 sets the cooling temperature to a cooling temperature lower than the set cooling temperature.

The reference medium temperature is set, for example, within a range from 10° C. to 20° C., and the reference in-apparatus temperature is set, for example, within a range from 20° C. to 26° C. The reference water content is set, for example, within a range from 4% to 7%, and the set cooling temperature is set, for example, within a range from 5° C. to 20° C. The cooling temperature is controlled, for example, by the temperature or the flow rate of the refrigerant that flows through the first cooling roll 21 and the second cooling roll 22.

The control unit 90 controls the humidification amount of the humidifier 30 based on the obtained measurement results of the cooling temperature, the medium temperature, the in-apparatus temperature, and the paper water content.

Specifically, for example, in a case where the cooling temperature is the given reference cooling temperature or lower, the medium temperature is the given reference medium temperature or lower, and the in-apparatus temperature is the given reference in-apparatus temperature or lower, and in a case where the paper water content is equal to or greater than the given reference water content, the control unit 90 sets the humidification amount of the humidifier 30 to a given set humidification amount an example of a set value). In a case where at least one of the following conditions is satisfied, the conditions including a condition in which the cooling temperature is higher than the given reference cooling temperature, a condition in which the medium temperature is higher than the given reference medium temperature, a condition in which the in-apparatus temperature is higher than the given reference in-apparatus temperature, and a condition in which paper water content is less than the given reference water content, the control unit 90 sets the humidification amount of the humidifier 30, for example, to a humidification amount greater than the set humidification amount.

For example, the reference cooling temperature is set within a range from 5° C. to 20° C., and the set humidification amount is set within a range from 50 ml/h to 400 ml/h. For example, the humidification amount of the humidifier 30 is controlled by the flow rate or the humidity of the humidified air that is blown from the air outlet 34.

It is described that the control unit 90 controls the cooling temperature based on the measurement results of the medium temperature, the in-apparatus temperature, and the paper water content. However, the control unit 90 may control the cooling temperature based on at least one of the measurement results of the medium temperature, the in-apparatus temperature, and the paper water content. In this case, a sensor from which the measurement result thereof is unused may not be provided.

It is described that the control unit 90 controls the humidification amount of the humidifier 30 based on the measurement results of the cooling temperature, the medium temperature, the in-apparatus temperature, and the paper water content. However, the control unit 90 may control the humidification amount of the humidifier 30 based on at least one of the measurement results of the cooling temperature, the medium temperature, the in-apparatus temperature, and the paper water content. In this case, a sensor from which the measurement result thereof is unused may not be provided.

In a case where at least one of the following conditions is satisfied, the conditions including a condition in which the medium temperature is lower than the given reference medium temperature, a condition in which the in-apparatus temperature is lower than the given reference in-apparatus temperature, and a condition in which the paper water content is greater than the given reference water content, the control unit 90 may set the cooling temperature to a cooling temperature higher than the set cooling temperature.

In a case where at least one of the following conditions is satisfied, the conditions including a condition in which the cooling temperature is lower than the given reference cooling temperature, a condition in which the medium temperature is lower than the given reference medium temperature, a condition in which the in-apparatus temperature is lower than the given reference in-apparatus temperature, and a condition in which the paper water content is greater than the given reference water content, the control unit 90 may set the humidification amount of the humidifier 30 to a humidification amount less than the set humidification amount.

Effects According to Present Embodiment

In the present embodiment, the continuous form paper P that is unwound from the unwinding roll 62 is cooled by the first cooling roll 21, and then cooled by the second cooling roll 22. In this state, the continuous form paper P is humidified by the humidifier 30.

The continuous form paper P that is humidified by the humidifier 30 is transported to the ejection heads 42K to 42C. The ink droplets of the respective colors are ejected on the continuous form paper P from the ejection heads 42K to 42C, and thus an image is formed on the continuous form paper P. The ink on the continuous form paper P on which the image is formed is dried by the drying unit 50, and then the dried continuous form paper P is wound by the winding roll 64.

In the present embodiment, the continuous form paper P is humidified in a state where the temperature of the continuous form paper P is lowered by the first cooling roll 21 and the second cooling roll 22. Therefore, the humidified air is supplied to the continuous form paper P in a state where saturated vapor pressure is low, and thus the water vapor in the humidified air supplied to the continuous form paper P is likely to condense, compared to a configuration in which the continuous form paper P is humidified at room temperature (comparative example). Accordingly, the humidified air is absorbed into the continuous form paper P as moisture, and thus the water content of the continuous form paper P increases, compared to a configuration in which the continuous form paper P is humidified at room temperature (comparative example). The continuous form paper P having a high water content is transported to the ejection heads 42K to 42C, and thus the continuous form paper P does not absorb moisture from the ejection heads 42K to 42C, thereby preventing the drying of the nozzles of the ejection heads 42K to 42C, compared to a configuration in which the continuous form paper P is humidified at room temperature (comparative example). Accordingly, an ejection failure such as non-ejection of the ink droplets from the nozzles is prevented.

The continuous form paper P has a high water content, and thus the charging of the continuous form paper P is prevented, thereby preventing ink mist from attaching to the nozzle surface of the ejection heads 42K to 42C by the repulsive force due to the charging of the continuous form paper P.

In the present embodiment, the supply width for supplying the humidified air to the continuous form paper P by the humidifier 30 is set to be equal to or narrower than the width of the continuous form paper P.

Therefore, components other than the continuous form paper P (for example, the first cooling roll 21 and the second cooling roll 22) are prevented from being humidified, compared to a configuration in which the supply width for supplying the humidified air to the continuous form paper P is wider than the width of the continuous form paper P (comparative example). Accordingly, dew condensation of components other than the continuous form paper P (for example, the first cooling roll 21 and the second cooling roll 22) is prevented.

In the present embodiment, the humidifier 30 includes the adjusting mechanism 36 that can adjust the supply width for supplying the humidified air to the continuous form paper P based on the width of the continuous form paper P.

Therefore, even in a case where the continuous form paper P having a different width is used, components other than the continuous form paper P (for example, the first cooling roll 21 and the second cooling roll 22) are prevented from being humidified, compared to a configuration in which the supply width for supplying the humidified air to the continuous form paper P is fixed to a specific width.

In the present embodiment, as described above, the control unit 90 controls the cooling temperatures of the first cooling roll 21 and the second cooling roll 22 based on the obtained measurement results of the medium temperature, the in-apparatus temperature, and the paper water content.

Therefore, the water content of the continuous form paper P is likely to be a desired water content, compared to a configuration in which the cooling, temperatures of the first cooling roll 21 and the second cooling roll 22 are controlled regardless of the medium temperature, the in-apparatus temperature, and the paper water content (comparative example).

In the present embodiment, as described above, the control unit 90 controls the humidification amount of the humidifier 30 based on the obtained measurement results of the cooling temperature, the medium temperature, the in-apparatus temperature, and the paper water content.

Therefore, the water content of the continuous form paper P is likely to be a desired water content, compared to a configuration in which the humidification amount of the humidifier 30 is controlled regardless of the cooling temperature, the medium temperature, the in-apparatus temperature, and the paper water content (comparative example).

Modification Example

In the present embodiment, the cooling unit 20 cools the continuous form paper P by using the first cooling roll 21 and the second cooling roll 22. However, the cooling unit 20 is not limited thereto. The cooling unit may cool the continuous form paper P by using one cooling roll or three or more cooling rolls. The cooling unit may not have a roll shape, and, for example, have a shape in which the contact portion between the continuous form paper P and the cooling unit is formed in a planar shape. The cooling unit may not be driven by the continuous form paper P, and may have a configuration in which the continuous form paper P moves with respect to the cooling unit while sliding in a state of being, in contact with the cooling unit. The cooling unit may be configured to cool the continuous form paper P in a non-contact manner with respect to the continuous form paper P. In this case, for example, the continuous form paper P is cooled by the cold air generated by the cooling unit.

In the present embodiment, the continuous form paper P is used as a recording medium P. However, cut paper with which the length in a transport direction is set to a given length may be used as the recording medium P.

The invention is not limited to the above-described embodiments, and various modifications, changes, and improvements are possible without departing from the spirit of the inventions. For example, the modification examples described above may be appropriately combined and configured.

Evaluation

In the above-mentioned image forming apparatus 10 (example) and an image forming apparatus (comparative example) that does not include the cooling unit 20 (the first cooling roll 21 and the second cooling roll 22) of the image forming apparatus 10, evaluation is performed by measuring the water content of the continuous form paper P.

In this evaluation, "NPi FORM (basis weight 64 g/m$^2$)" manufactured by Nippon Paper Industries Co., Ltd. is used as the continuous form paper P, and the evaluation is performed under the environment in which the in-apparatus temperature of the image forming apparatus is 24° C. and the in-apparatus humidity of the image forming apparatus is 40% RH. The humidification amount of the humidifier 30 is set to 200 ml/h such that the humidity in the vicinity of the portion of the continuous form paper P facing the air outlet 34 is 70%.

The image forming apparatus 10 according to the example sets the cooling temperature of the second cooling, roll 22 to 15° C.

As a result, in the image forming apparatus 10 according to the example, the water content of the continuous form paper P reaches 5%, whereas, in the image forming apparatus according to the comparative example, the water content of the continuous form paper P reaches 2.7%. When the water content of the continuous form paper P is less than 4%, as described above, the continuous form paper P absorbs moisture from the nozzles of the ejection unit 40, and thus this may cause an ejection failure of the ink.

Second Embodiment

Image Forming Apparatus 200

Figure 5:
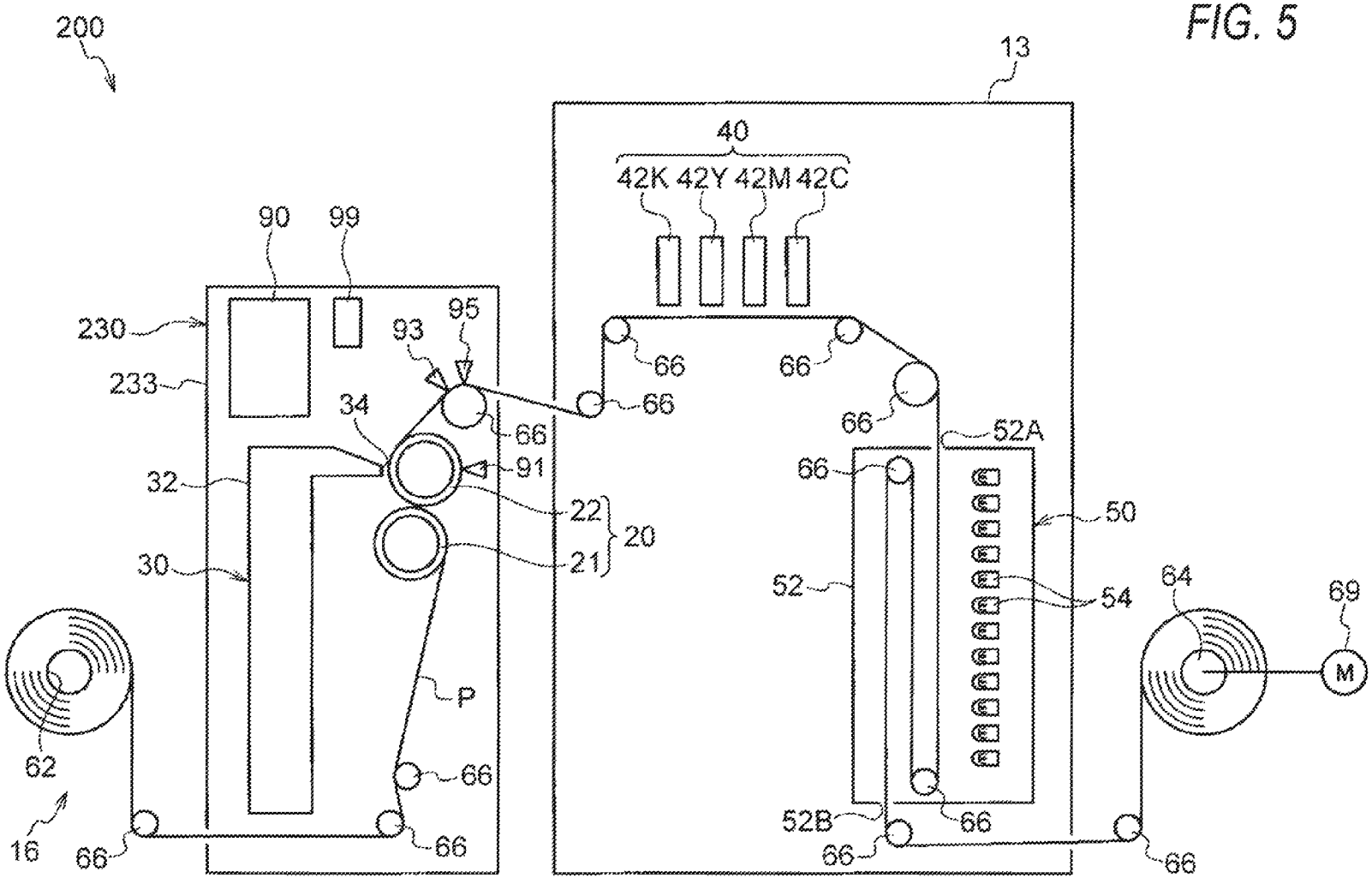
FIG. 5 is a schematic diagram illustrating a configuration of an image forming apparatus according to a second embodiment.

First, an image forming apparatus 200 (an example of an ejection apparatus) will be described. The same reference numerals are given to the portions having the same configuration as that of the first embodiment, and detailed description thereof will be appropriately omitted. FIG. 5 is a schematic diagram illustrating the configuration of the image forming apparatus 200.

As illustrated in FIG. 5, the image forming apparatus 200 includes a transport unit 16 transporting the continuous form paper P an example of a recording medium), an image forming apparatus main body 13 (housing), and a humidification apparatus 230.

The image forming apparatus main body 13 is provided with an ejection unit 40 ejecting ink droplets (an example of droplets) on the continuous form paper P (an example of an ejection portion), and a drying unit 50 drying the ink on the continuous form paper P.

A humidification apparatus 230 includes a humidification apparatus main body 233, a cooling unit 20 cooling the continuous form paper P (an example of a recording medium) that is transported toward the ejection unit 40, a humidifier 30 (an example of humidification unit) humidifying the continuous form paper P, and a control unit 90 controlling each unit of the humidification apparatus 230. Further, the humidification apparatus 230 includes a temperature sensor 99 that measures the temperature of the inside of the humidification apparatus main body 233, a temperature sensor 91 that measures the temperature of the cooling unit 20, a temperature sensor 93 that measures the temperature of the continuous form paper P, and a water content sensor 95 that measures the water content of the continuous form paper P.

Effects of the Second Embodiment

The second embodiment has similar effects as those of the first embodiment described above. In other words, in the second embodiment, the continuous form paper P that is unwound from the unwinding roll 62 is cooled by the first cooling roll 21, and then cooled by the second cooling roll 22. In this state, the continuous form paper P is humidified by the humidifier 30.

The continuous form paper P that is humidified by the humidifier 30 is transported to the ejection heads 42K to 42C. The ink droplets of the respective colors are ejected on the continuous form paper P from the ejection beads 42K to 42C, and thus an image is formed on the continuous form paper P. The ink on the continuous form paper P on which the image is formed is dried by the drying unit 50, and then the dried continuous form paper P is wound by the winding roll 64.

In the present embodiment, the continuous form paper P is humidified in a state where the temperature of the continuous form paper P is lowered by the first cooling roll 21 and the second cooling roll 22. Therefore, the humidified air is supplied to the continuous form paper P in a state where saturated vapor pressure is low, and thus the water vapor in the humidified air supplied to the continuous form paper P is likely to condense, compared to a configuration in which the continuous form paper P is humidified at room temperature (comparative example). Accordingly, the humidified air is absorbed into the continuous form paper P as moisture, and thus the water content of the continuous form paper P increases, compared to a configuration in which the continuous form paper P is humidified at room temperature (comparative example). The continuous form paper P having a high water content is transported to the ejection heads 42K to 42C, and thus the continuous form paper P does not absorb moisture from the ejection heads 42K to 42C, thereby preventing the drying of the nozzles of the ejection heads 42K to 42C, compared to a configuration in which the continuous form paper P is humidified at room temperature (comparative example). Accordingly, an ejection failure such as non-ejection of the ink droplets from the nozzles is prevented.

The continuous form paper P has a high water content, and thus the charging of the continuous form paper P is prevented, thereby preventing ink mist from attaching to the nozzle surface of the ejection heads 42K to 42C by the repulsive force due to the charging of the continuous form paper P.

Third Embodiment

Image Forming Apparatus 300

Figure 6:
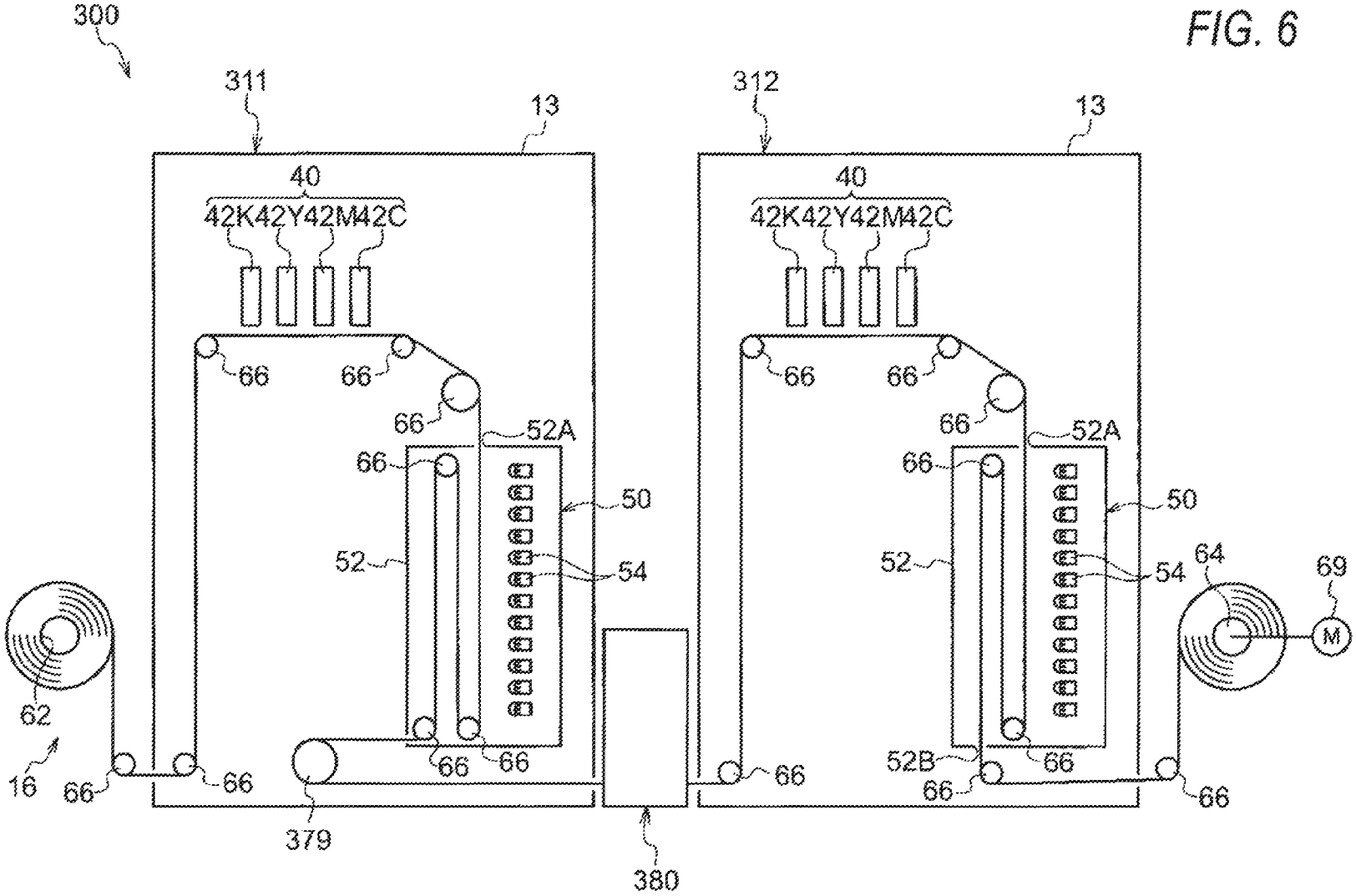
FIG. 6 is a schematic diagram illustrating the configuration of an image forming apparatus according to a third embodiment.

First, an image forming apparatus 300 (an example of an ejection apparatus) will be described. The same reference numerals are given to the portions having the same configuration as that of the first embodiment, and detailed description thereof will be appropriately omitted. FIG. 6 is a schematic diagram illustrating the configuration of the image forming apparatus 300.

As illustrated in FIG. 6, the image forming apparatus 300 includes a first image forming apparatus 311 that forms an image on the front surface (an example of one side surface) of the continuous form paper P, a second image forming apparatus 312 that forms an image on the back surface (an example of the other side surface) of the continuous form paper P, and a transport unit 316 that transports the continuous form paper P (an example of a recording medium).

The transport unit 316 includes an unwinding roll 62 unwinding the continuous form paper P, a winding roll 64 winding the continuous form paper P, a reversing device 380 reversing the front surface and the back surface of the continuous form paper P (an example of the humidification apparatus), and plural transport rolls 66 transporting the continuous form paper P. The winding roll 64 is rotatably driven by a drive unit 69. Accordingly, the winding roll 64 winds the continuous form paper P, and the unwinding roll 62 unwinds the continuous form paper P.

The plural transport rolls 66 are wound with the continuous form paper P between the unwinding roll 62 and the winding roll 64. Accordingly, the transporting path of the continuous form paper P from the unwinding roll 62 to the winding roll 64 is determined. The winding roll 64 winds the continuous form paper P, and thus the plural transport rolls 66 are driven to rotate by the continuous form paper P which progresses to the winding roll 64 side.

In the present embodiment, in the transporting path from the unwinding roll 62 to the winding roll 64, the first image forming apparatus 311 is disposed at the upstream side (the unwinding roll 62 side), and the second image forming apparatus 312 is disposed at the downstream side (the winding roll 64 side).

The reversing device 380 is disposed between the first image forming apparatus 311 and the second image forming apparatus 312 in the transporting path from the unwinding roll 62 to the winding roll 64.

Accordingly, the reversing device 380 reverses the front surface and the back surface of the continuous form paper P which is unwound from the unwinding roll 62 and transported to the first image forming apparatus 311, and the continuous form paper P in which the front surface and the back surface thereof is reversed is transported to the second image forming apparatus 312. The reversed continuous form paper P is wound by the winding roll 64.

The first image forming apparatus 311 includes an image forming apparatus main body 13 (housing), an ejection unit 40 (an example of an ejection portion) ejecting ink droplets (an example of droplets) on the continuous form paper P, a drying unit 50 drying the ink on the continuous form paper P, and a cooling roll 379 cooling the continuous form paper P.

The outer peripheral surface of the cooling roll 379 is wound around the image forming surface of the continuous form paper P. Accordingly, the outer peripheral surface of the cooling roll 379 is in contact with the image forming surface of the continuous form paper P, and thus the continuous form paper P is cooled. The cooling roll 379 is configured to be driven to rotate by the continuous form paper P which progresses to the winding roll 74 side. In other words, the cooling roll 379 also functions as a transport roll.

The second image forming apparatus 312 includes an image forming apparatus main body 13 (housing), an ejection unit 40 (an example of an ejection portion) electing ink droplets (an example of droplets) on the continuous form paper P, and a drying unit 50 drying the ink on the continuous form paper P.

Figure 7:
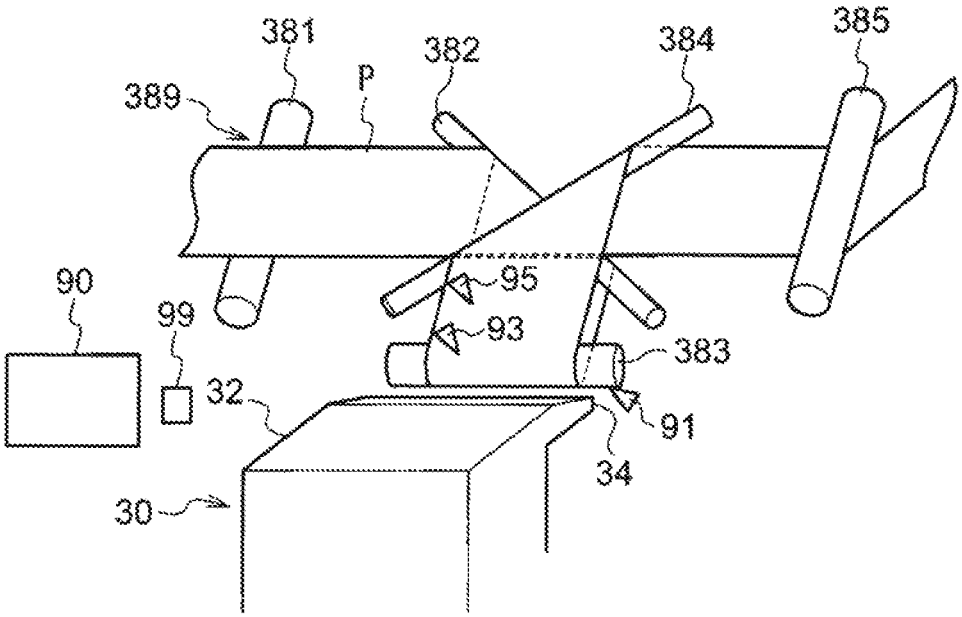
FIG. 7 is a schematic diagram illustrating the configuration of a reversing device according to the third embodiment.

As illustrated in FIG. 7, the reversing device 380 is provided with a reversing mechanism 389 having five transport rolls 381, 382, 383, 384, and 385. The continuous form paper P on which the image is formed on the front surface by the first image forming apparatus 311 progresses to the right side in FIG. 7 by the transport roll 381, and then is folded back toward the front side of FIG. 7 by the transport roll 382. Further, the continuous form paper P is folded back toward the back side of FIG. 7 by the transport roll 383, and then folded back toward the right side of FIG. 7 by the transport roll 384. Accordingly, the back surface of the continuous form paper P is reversed to face upward. The reversed continuous form paper P progresses to the right side in FIG. 7 by the transport roll 385, and then transported to the second image forming apparatus 312.

The transport roll 383 has the same configuration as that of the second cooling roll 22 described above, and functions as an example of a cooling unit that cools the continuous form paper P. The reversing device 380 includes the humidifier 30 (an example of a humidification unit) humidifying the continuous form paper P, and the control unit 90 controlling each unit of the humidification apparatus 230. In addition, the reversing device 380 includes the temperature sensor 99 measuring the temperature of the inside of the reversing device 380, the temperature sensor 91 measuring the temperature of the transport roll 383, the temperature sensor 93 measuring the temperature of the continuous form paper P, and the water content sensor 95 measuring the water content of the continuous form paper P.

Effects According to Third Embodiment

The third embodiment has the same effect as that of the above-described first embodiment. In other words, in the third embodiment, the continuous form paper P that is unwound from the unwinding roll 62 is transported to the first image forming apparatus 311. In the first image forming apparatus 311, the ejection operation, the drying operation and the cooling operation are performed in this order on the front surface of the continuous form paper P. Accordingly, an image is formed on the from surface of the continuous form paper P. The continuous form paper P on which the image is formed on the front surface is transported to the reversing device 380. In the reversing device 380, the continuous form paper P is humidified by the humidifier 30 in a state of being cooled by the transport roll 383.

The front surface and the back surface of the continuous form paper P that is humidified by the humidifier 30 is reversed, and then the reversed continuous form paper P is transported to the ejection heads 42K to 42C of the second image forming apparatus 312. Ink droplets of the respective colors are ejected on the back surface of the continuous form paper P from the ejection heads 42K to 42C, and thus an image is formed on the back surface of the continuous form paper P. The ink on the continuous form paper P on which the image is formed on the back surface is dried by the drying unit 50, and then the dried continuous form paper P is wound by the winding roll 64.

In the present embodiment, the continuous form paper P is humidified in a state where the temperature of the continuous form paper P is lowered by the transport roll 383. Therefore, the humidified air is supplied to the continuous form paper P in a state where saturated vapor pressure is low, and thus the water vapor in the humidified air supplied to the continuous form paper P is likely to condense, compared to a configuration in which the continuous form paper P is humidified at room temperature (comparative example). Accordingly, the humidified air is absorbed into the continuous form paper P as moisture, and thus the water content of the continuous form paper P increases, compared to a configuration in which the continuous form paper P is humidified at room temperature (comparative example). The continuous form paper P having a high water content is transported to the ejection beads 42K to 42C, and thus the continuous form paper P does not absorb moisture from the ejection heads 42K to 42C, thereby preventing the drying of the nozzles of the ejection heads 42K to 42C, compared to a configuration in which the continuous form paper P is humidified at room temperature (comparative example).

Accordingly, an ejection failure such as non-ejection of the ink droplets from the nozzles is prevented.

The continuous form paper P has a high water content, and thus the charging of the continuous form paper P is prevented, thereby preventing ink mist from attaching to the nozzle surface of the ejection heads 42K to 42C by the repulsive force due to the charging of the continuous form paper P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An ejection apparatus comprising:

a cooling unit that cools a recording medium;

a humidification unit that humidifies the recording medium in a state of the recording medium having a temperature lowered by the cooling unit; and an ejection unit that ejects droplets on the recording medium that is humidified by the humidification unit, wherein the humidification unit has a supply width that supplies humidified air to the recording medium and that is equal to or narrower than the width of the recording medium, and the humidification unit includes an adjusting mechanism for adjusting the supply width.

2. An ejection apparatus comprising:

a cooling unit that cools a recording medium;

a humidification unit that humidifies the recording medium in a state of the recording medium having a temperature lowered by the cooling unit;

an ejection unit that ejects droplets on the recording medium that is humidified by the humidification unit; and a control unit that controls the humidification unit such that a humidification amount from the humidification unit is greater than a given set value in a case where at least one of following conditions is satisfied: the conditions including a condition in which a cooling temperature of the cooling unit is higher than a reference cooling temperature; a condition in which a medium temperature of the recording medium is higher than a reference medium temperature; a condition in which an in-apparatus temperature of an inside of the ejection apparatus is higher than a reference in-apparatus temperature; and a condition in which a water content of the recording medium is lower than a reference water content.

3. The ejection apparatus according to claim 2, wherein the humidification unit has a supply width that supplies humidified air to the recording medium and that is equal to or narrower than the width of the recording medium.

4. The ejection apparatus according to claim 3, wherein the humidification unit includes an adjusting mechanism for adjusting the supply width.

5. An ejection apparatus comprising:

a cooling unit that cools a recording medium;

a humidification unit that humidifies the recording medium in a state of the recording medium having a temperature lowered by the cooling unit;

an ejection unit that ejects droplets on the recording medium that is humidified by the humidification unit; and a control unit that controls the cooling unit such that the cooling temperature of the cooling unit is lower than a given set value, in a case where at least one of following conditions is satisfied: the conditions including a condition in which a medium temperature of the recording medium is higher than a reference medium temperature; a condition in which an in-apparatus temperature of the inside of the ejection apparatus is higher than a reference in-apparatus temperature; and a condition in which a water content of the recording medium is lower than a reference water content.

6. The ejection apparatus according to claim 5, wherein the humidification unit has a supply width that supplies humidified air to the recording medium and that is equal to or narrower than the width of the recording medium.

7. The ejection apparatus according to claim 6, wherein the humidification unit includes an adjusting mechanism for adjusting the supply width.

8. A humidification apparatus comprising:

a cooling unit that cools a recording medium being transported toward an ejection unit that ejects droplets; and a humidification unit that humidifies the recording medium in a state of the recording medium having a temperature lowered by the cooling unit, wherein the humidification unit has a supply width that supplies humidified air to the recording medium and that is equal to or narrower than the width of the recording medium, and the humidification unit includes an adjusting mechanism for adjusting the supply width.

9. The humidification apparatus according to claim 8, further comprising:

a reversing mechanism that reverses a front surface and a back surface of the recording medium on which an image is formed on one side surface.

10. The humidification apparatus according to claim 8, further comprising:

a control unit that controls the humidification unit such that a humidification amount from the humidification unit is greater than a given set value in a case where at least one of following conditions is satisfied: the conditions including a condition in which a cooling temperature of the cooling unit is higher than a reference cooling temperature; a condition in which a medium temperature of the recording medium is higher than a reference medium temperature; a condition in which an in-apparatus temperature of an inside of the ejection apparatus is higher than a reference in-apparatus temperature; and a condition in which a water content of the recording medium is lower than a reference water content.

11. The humidification apparatus according to claim 8, further comprising:

a control unit that controls the cooling unit such that the cooling temperature of the cooling unit is lower than a given set value, in a case where at least one of following conditions is satisfied: the conditions including a condition in which a medium temperature of the recording medium is higher than a reference medium temperature; a condition in which an in-apparatus temperature of the inside of the ejection apparatus is higher than a reference in-apparatus temperature; and a condition in which a water content of the recording medium is lower than a reference water content.

* * * * *